US010934135B2

(12) United States Patent
Schuster

(10) Patent No.: US 10,934,135 B2
(45) Date of Patent: Mar. 2, 2021

(54) ELEVATOR SYSTEM WITH ADAPTIVE DOOR CONTROL

(71) Applicant: Inventio AG, Hergiswil (CH)

(72) Inventor: Kilian Schuster, Emmenbrücke (CH)

(73) Assignee: Inventio AG

( * ) Notice: Subject to any disclaimer, the term of this patent is extended or adjusted under 35 U.S.C. 154(b) by 686 days.

(21) Appl. No.: 15/552,767

(22) PCT Filed: Feb. 23, 2016

(86) PCT No.: PCT/EP2016/053715
§ 371 (c)(1),
(2) Date: Aug. 22, 2017

(87) PCT Pub. No.: WO2016/135114
PCT Pub. Date: Sep. 1, 2016

(65) Prior Publication Data

US 2018/0265333 A1 Sep. 20, 2018

(30) Foreign Application Priority Data

Feb. 23, 2015 (EP) ..... 15156202

(51) Int. Cl.
*B66B 13/14* (2006.01)
*B66B 1/34* (2006.01)
(Continued)

(52) U.S. Cl.
CPC ..... *B66B 13/146* (2013.01); *B66B 1/3476* (2013.01); *B66B 1/468* (2013.01);
(Continued)

(58) Field of Classification Search
CPC ..... B66B 13/146; B66B 1/3476; B66B 1/468; B66B 5/0012; B66B 9/00; B66B 13/14; B66B 13/26; B66B 2201/00
(Continued)

(56) References Cited

U.S. PATENT DOCUMENTS 5,024,295 A * 6/1991 Thangavelu ..... B66B 1/2458 187/382
5,168,136 A * 12/1992 Thangavelu ..... B66B 1/2466 187/247
(Continued)

FOREIGN PATENT DOCUMENTS

CN 101531320 A 9/2009
CN 103910272 A 7/2014
(Continued)

OTHER PUBLICATIONS

Merad, Djamel, et al., 2010 Seventh IEEE International Conference on Advanced Video and Signal Based Surveillance: Fast People Counting Using Head Detection From Skeleton Graph, pp. 233-240.
(Continued)

*Primary Examiner* — David S Warren
(74) *Attorney, Agent, or Firm* — Bressler, Amery and Ross; Pierre R. Yanney

(57) ABSTRACT

Methods and systems to control an elevator door of an elevator car that can be moved between floors of a building. At least one registered destination call is evaluated, which makes it possible to plan the number of boarding or exiting passengers for each stopping floor. For each stopping floor, a corresponding door dwell time for the elevator door is determined to make it possible for a registered passenger to board or exit on a stopping floor. The number of passengers that exit the elevator car on the stopping floor and the number of passengers that board the elevator car on the stopping floor is also determined. The elevator door is closed regardless of the set door dwell time if the number of passengers boarding and exiting on the stopping floor determined by the sensor system corresponds to the number of boarding or exiting passengers planned for the stopping floor.

13 Claims, 2 Drawing Sheets

(51) Int. Cl.
*B66B 1/46* (2006.01)
*B66B 5/00* (2006.01)
*B66B 9/00* (2006.01)
*B66B 13/26* (2006.01)

(52) U.S. Cl.
CPC ..... *B66B 5/0012* (2013.01); *B66B 9/00* (2013.01); *B66B 13/14* (2013.01); *B66B 13/26* (2013.01); *B66B 2201/00* (2013.01)

(58) Field of Classification Search
USPC ..... 187/247
See application file for complete search history.

(56) References Cited

U.S. PATENT DOCUMENTS 5,235,143 A * 8/1993 Bahjat ..... B66B 13/143 187/316
5,286,930 A * 2/1994 Bittar ..... B66B 13/143 187/316
5,345,049 A * 9/1994 Bahjat ..... B66B 1/2458 187/382
5,387,768 A * 2/1995 Izard ..... G06F 7/00 187/392
5,714,725 A * 2/1998 Thangavelu ..... B66B 1/2458 187/382
5,750,946 A * 5/1998 Thangavelu ..... B66B 1/2458 187/382
5,760,350 A * 6/1998 Pepin ..... B66B 13/143 187/316
5,767,460 A * 6/1998 Thangavelu ..... B66B 1/2458 187/382
5,767,462 A * 6/1998 Thangavelu ..... B66B 1/2458 187/382
5,786,550 A * 7/1998 Thangavelu ..... B66B 1/2458 187/380
5,786,551 A * 7/1998 Thangavelu ..... B66B 1/2458 187/380
5,808,247 A * 9/1998 Thangavelu ..... B66B 1/2458 187/382
5,841,084 A * 11/1998 Thangavelu ..... B66B 1/2458 187/382
5,984,051 A * 11/1999 Morgan ..... B66B 1/2408 187/392
6,328,135 B1 * 12/2001 Sirag, Jr. ..... B66B 1/2458 187/382
7,128,190 B2 10/2006 Kostka et al.
8,020,672 B2 * 9/2011 Lin ..... B66B 1/468 187/392
8,220,591 B2 * 7/2012 Atalla ..... B66B 1/20 187/383
8,839,913 B2 * 9/2014 Atalla ..... B66B 1/20 187/383
2005/0103577 A1 * 5/2005 Warner ..... B66B 13/26 187/317
2006/0037818 A1 * 2/2006 Deplazes ..... B66B 1/3476 187/392
2009/0057068 A1 * 3/2009 Lin ..... B66B 1/34 187/392
2009/0108987 A1 * 4/2009 Shikai ..... B66B 13/26 340/3.1
2009/0208067 A1 * 8/2009 Peng ..... B66B 5/0012 382/115
2009/0216376 A1 * 8/2009 Atalla ..... B66B 1/20 700/275
2012/0255813 A1 * 10/2012 Atalla ..... B66B 1/20 187/382
2015/0075914 A1 * 3/2015 Armistead ..... B66B 1/46 187/247
2016/0292522 A1 * 10/2016 Chen ..... B66B 1/3476
2016/0295192 A1 * 10/2016 Hsu ..... G06K 9/00832
2016/0295196 A1 * 10/2016 Finn ..... G06T 7/11
2018/0093859 A1 * 4/2018 Stranieri ..... B66B 1/2408
2018/0111793 A1 * 4/2018 Miyajima ..... B66B 5/0018
2018/0265333 A1 * 9/2018 Schuster ..... B66B 13/14
2019/0023527 A1 * 1/2019 Larmuseau ..... B66B 1/468
2019/0202658 A1 * 7/2019 Lotfi ..... B66B 9/00
2019/0218059 A1 * 7/2019 Backlund ..... B66B 1/3476

FOREIGN PATENT DOCUMENTS

EP 0452130 A2 10/1991
EP 0544541 A2 6/1993
EP 1930276 A1 6/2008
JP 2010-58859 A 3/2010
JP 2010-064866 A 3/2010
JP 2010070326 A 4/2010
JP 2013-230922 A 11/2013
JP 2014114129 A 6/2014
JP 2014-131932 A 7/2014
WO 2007034560 A1 3/2007

OTHER PUBLICATIONS

ARS: Bildverarbeitungssoftware.
IEE: People Counter PC, https://www.iee.lu/media/571896f44064d_120824-fs-people-counter-en-web.pdf.
SenSource: ClearCount Active IR People Counter, https://www.sensourceinc.com/content/documents/PC-VAIR-5-N-2.pdf.

* cited by examiner

ELEVATOR SYSTEM WITH ADAPTIVE DOOR CONTROL

CROSS-REFERENCE TO RELATED APPLICATIONS

This application is the national phase application under 35 U.S.C. § 371 claiming the benefit of priority based on International Patent Application No. PCT/EP2016/053715, filed on Feb. 23, 2016, which claims the benefit of priority based on European Patent Application No. 15156202.2, filed on Feb. 23, 2015. The contents of each of these applications are herein incorporated by reference.

FIELD OF INVENTION

The technology described herein generally relates to an elevator system having a device for controlling the doors of the elevator system. Moreover, exemplary embodiments of the technology relate to a method for controlling the doors of the elevator system.

BACKGROUND OF THE INVENTION

An elevator system having a dynamically modifiable door dwell time is known from EP0544541, which defines it as a period of time during which the system keeps the door open before a command is given to close it. According to EP0544541, a fixed door dwell time may cause the doors to close early while passengers are still entering and/or exiting, and when the closing doors come into contact with one or more passengers it results in the doors reversing direction ("door reversal"). The door reversal costs additional time, which makes the transport capacity worse. The method that is therefore suggested in EP0544541 for controlling the door dwell time continuously compares an actual value of the door dwell time with a set value. When the intensity and scope of the traffic fluctuates in the course of the day, the door dwell times also change to achieve optimum servicing and waiting times throughout the entire day.

U.S. Pat. No. 7,128,190 deals with measures for increasing the transport capacity during peak hours with transport spikes. According to U.S. Pat. No. 7,128,190, however, no truly tangible increase of the transport capacity can be achieved using known measures, for example shortening or optimizing the door dwell times. Instead, for a zonally operated elevator system having a destination-call control, U.S. Pat. No. 718,190 suggests making it possible to change between zones on a changeover floor. An incoming elevator group and an outgoing elevator group are combined in a multigroup that is controlled by a multigroup control.

The aforementioned solutions are based on various approaches to the improvement of the transport capacity. There is a need for improved technology with regard to the improvement of the transport capacity.

SUMMARY OF THE INVENTION

One aspect of such an improved technology relates to an elevator system having an elevator car, a control device and a sensor system. The elevator car can be moved between the floors of a building and has an elevator door and a door control device for controlling the elevator door. The control device is communicatively connected to the door control and designed to evaluate at least one registered destination call that defines a passenger's desired trip from a boarding floor to an exit floor. The destination-call evaluation makes it possible to plan the number of boarding or exiting passengers for each stopping floor and determine a corresponding door dwell time for the elevator door to make it possible for a registered passenger to board or exit on a stopping floor. The sensor system is communicatively connected to the control device and designed to determine the number of passengers exiting the elevator car on a stopping floor and the number of passengers entering the elevator car on a stopping floor. The control device is designed in such a way that it causes the elevator door to close regardless of the set door dwell time if the number of passengers boarding and exiting on the stopping floor determined by the sensor system corresponds to the number of boarding or exiting passengers planned for the stopping floor.

Another aspect relates to a method for controlling an elevator door of an elevator car that can be moved between the floors of a building. At least one registered destination call that defines a passenger's desired trip from a boarding floor to an exit floor is evaluated. The destination-call evaluation makes it possible to plan the number of boarding or exiting passengers for each stopping floor. For each stopping floor, a corresponding door dwell time for the elevator door is determined to make it possible for a registered passenger to board or exit on a stopping floor. The method also determines the number of passengers that exit the elevator car on the stopping floor and the number of passengers that board the elevator car on the stopping floor. The elevator door is closed regardless of the set door dwell time if the determined number of passengers boarding and exiting on the stopping floor corresponds to the number of boarding or exiting passengers planned for the stopping floor.

According to this technology, the length of time during which the elevator door is open can be adapted to the actual passenger situation on a stopping floor. As a result, the length of time during which the elevator floor is at the stopping floor can be reduced; the door can be closed in a time-optimized manner. However, a door dwell time that is determined solely on the basis of a destination-call evaluation may be too long because a reserve factor can be included to prevent an elevator door that is already closing from being opened again (referred to here as "door reversal") because, for example, it touches a passenger who is boarding. If the door dwell time is too long, the transport capacity is not utilized optimally. The transport capacity worsens, however, if the door actually reverses directions, which causes an increase in the door dwell time and a longer stop on the floor.

In one exemplary embodiment, the control device causes the elevator door to close according to the set door dwell time if the number of passengers boarding and exiting on the stopping floor determined by the sensor system is lower than the number of boarding or exiting passengers planned for the stopping floor. The set door dwell time is enough for the actual number of passengers such that a door reversal is unlikely.

However, if the number of passengers boarding and exiting on the stopping floor determined by the sensor system is larger than the number of boarding or exiting passengers planned for the stopping floor, the control device causes the elevator door to close in a further exemplary embodiment if there is a passenger movement that corresponds to the number of passengers boarding and exiting on the stopping floor determined by the sensor system. In this case a door reversal is also usually unlikely.

In one exemplary embodiment of the elevator system, the elevator door has a safety device for detecting an obstruction (e.g. passenger or object) in a doorway. The safety device prevents the elevator door from closing when an obstruction is detected.

According to one exemplary embodiment, passengers are continuously recorded, for example counted, as they board and exit. As soon as the number of passengers planned by way of the destination-call evaluation is reached (for example, if one passenger exits on a stopping floor and two board), the door is closed. If this cannot immediately be done, for example because the safety device indicates a blocked doorway caused by additional passengers who are boarding and exiting, the number of passengers is determined up to the final closing and forwarded to the control device. In this case, the elevator door closes as soon as the safety device permits it.

In one exemplary embodiment, the sensor system includes a camera system with which the number of boarding and exiting passengers can be determined. The camera system includes at least one camera. In another exemplary embodiment, the sensor system includes a system having 3D sensors with which the number of boarding and exiting passengers can likewise be determined. These components, i.e. the camera and 3D sensors, can be arranged in the elevator system flexibly and as required. For example, a component can be arranged on each floor, or on the elevator car, or on each floor and on the elevator car.

BRIEF DESCRIPTION OF THE DRAWINGS

Various aspects of the improved technology are explained in more detail below using exemplary embodiments in conjunction with the figures. Identical elements have the same reference characters in the figures. Shown are.

DETAILED DESCRIPTION OF EMBODIMENTS OF THE INVENTION

Figure 1:
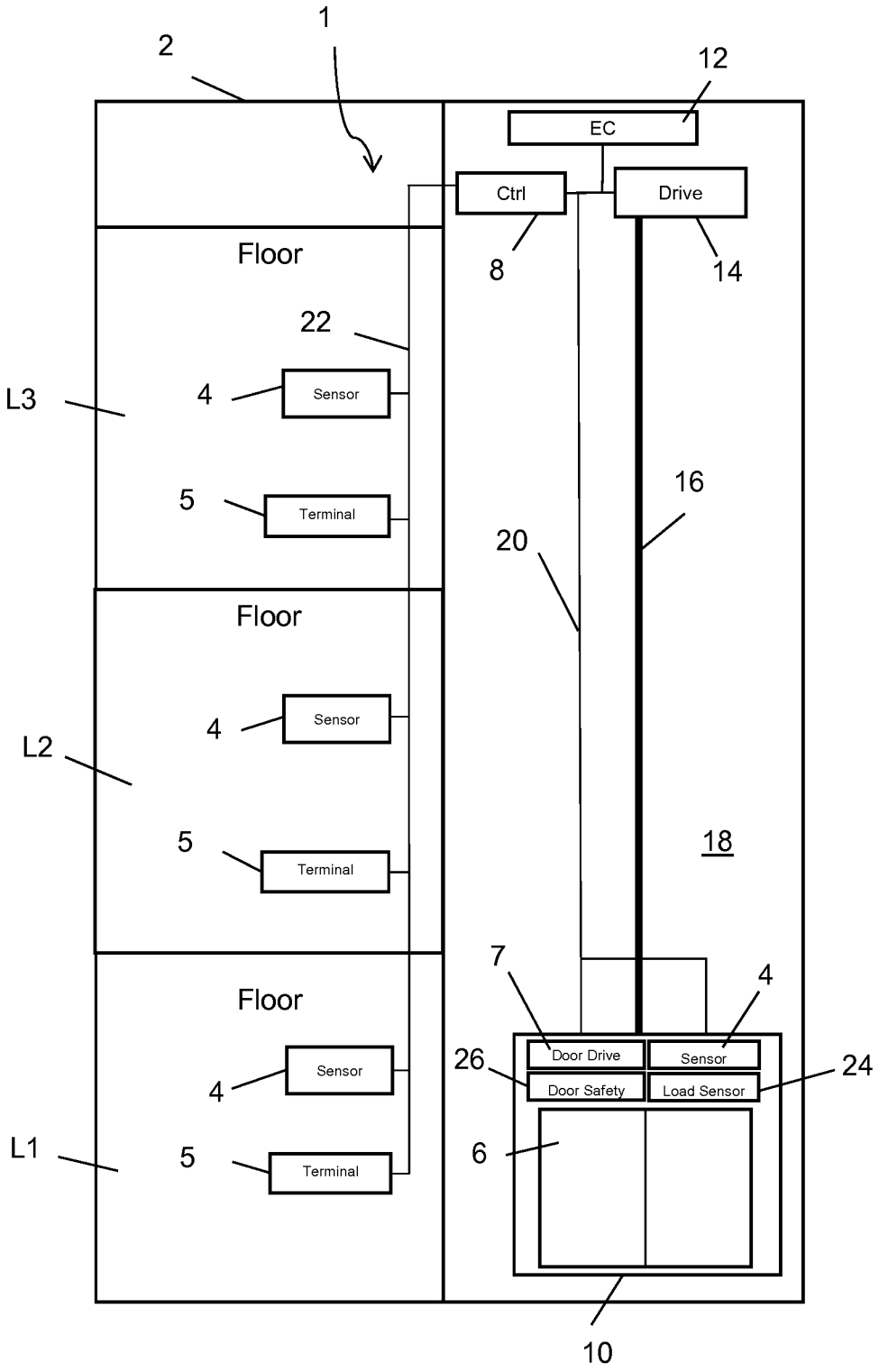
FIG. 1: a schematic depiction of an exemplary embodiment of an elevator system having a sensor system.

FIG. 1 shows a schematic depiction of an exemplary embodiment of an elevator system 1 in a building 2. Building 2 has several floors L1, L2, L3 that are served by elevator system 1, i.e. a passenger can be carried by elevator system 1 from a boarding floor to a destination floor. Depending on building 2, elevator system 1 can be designed in different ways, for example as a traction elevator having cables or belts, as a hydraulic elevator, as an elevator having multiple cars, or as a group of several elevators (e.g. a group of six elevators, wherein each one has an elevator car (per shaft)). In the exemplary embodiment shown, elevator system 1 has an elevator car 10 that can be moved within an elevator shaft 18, hereinafter referred to as car 10, and is connected to a drive unit 14 via a suspension means 16 (cable or belt) and suspended on this drive unit 14. This can be a traction elevator, wherein further details, such as e a counterweight and guide rails, are being shown in FIG. 1. An elevator control (EC) 12 is connected to drive unit 14 and controls drive unit 14. The function of a traction elevator and the tasks of an elevator control 12 are generally known to those skilled in the art.

According to an exemplary embodiment of the technology described here, elevator system 1, which is shown in FIG. 1, is equipped with a destination-call control. In the case of a destination-call control, a passenger enters the desired destination floor in a known manner while already on a floor. The function of the destination-call control is implemented in the exemplary embodiment shown in a control device (Ctrl) 8, but it can also be implemented in elevator control 12. Control device 8 and elevator control 12 can be combined into one control unit.

For entering a destination call, a number of floor terminals 5 are provided in elevator system 1 that are communicatively connected to control device 8 via a line 22. In the exemplary embodiment shown, building 2 has three floors L1, L2, L3 and there is a floor terminal 5 on each floor. However, it is possible that there are only two or more than three floors. It is also possible that there is more than one floor terminal 5 on a floor L1, L2, L3.

Control device 8 is additionally connected communicatively to elevator control 12. In this description, a communicative connection refers to a direct or indirect connection that enables unidirectional or bidirectional communication between two units. Data signals and/or control signals are transmitted in a manner that is known per se. Such a connection can be made using an electrical line system (either as a system of point-to-point connections or as a bus system, wherein the units connected to the bus system are addressable), a radio system or a combination of a radio system and a line system. In FIG. 1, the communicative connection is shown by way of example by lines 20, 22, wherein line 20 is between control device 8 and car 10 and line 22 connecting floor terminals 5 to control device 8. In one exemplary embodiment, line 22 can be a bus system to which floor terminals 5 are connected. Similarly, line 20 can also be a bus system.

In another exemplary embodiment, at least one floor terminal 5 can be connected communicatively to control device 8 via a radio system. It is also possible that the functionality of a floor terminal 5 is implemented in a mobile electronic device (e.g., a mobile phone, smartphone, smartwatch). A user of this device can use it to enter a destination call and receive a message (e.g., "elevator A") about the elevator allocated to this destination call.

Those skilled in the art recognize that control device 8 or its functionality can also be part of elevator control 12 or of a floor terminal 5. In such a case, for example, the separate depiction of control device 8 in FIG. 1 could be omitted. If control device 8 or its functionality are integrated into elevator control 12, elevator control 12 represents the control device. Depending on the design, the implementation of the communicative connection therefore varies. FIG. 1 is thus obviously a basic depiction of an exemplary embodiment.

Elevator control 12 controls the operation of car 10, for example, as a function of the incoming destination calls. For example, if car 10 reaches a boarding floor, elevator control 12 generates (e.g., based on a current position of car 10) a control signal for a door drive 7 that is arranged on car 10 and controls an elevator door 6. Door drive 7 is coupled to line 20. Triggered by the control signal, door drive 7 opens elevator door 6 and a passenger can board car 10. Once a door dwell time has elapsed, door drive 7 closes elevator door 6 and car 10 can be moved to the destination floor.

In known elevator systems 1, there is landing door on each floor L1, L2, L3 that closes off elevator shaft 18 if no elevator car 10 is ready for boarding/exiting on the floor L1, L2, L3. In addition to this, elevator car 10 has a car door that is controlled by door drive 7 and closes off elevator car 10 during the trip. The car door unlocks and moves (opens/closes) the landing door essentially synchronously with the car door. For the sake of simplicity, no distinction is made between a car door and a landing door in the exemplary embodiments described here. Elevator door 6 thus includes the car door and the landing door.

As mentioned above, the door dwell time, according to the technology described here, is not set in a fixed manner, but in a dynamic manner to optimize transport capacity. This means that the door dwell time on a floor L1, L2, L3 depends on how many passengers would actually like to board and exit on this floor L1, L2, L3. To dynamically adapt the door dwell time to the actual needs, elevator system 1 utilizes a sensor system having one or more sensors 4, 6*b*. As shown in FIG. 1, a sensor 4 can be present on each floor L1, L2, L3, wherein each sensor 4 is coupled to line 22. FIG. 1 also shows that a sensor 4 can be present on or in car 10, wherein sensor 4 is coupled to line 20.

The sensor system detects boarding and exiting passengers on a floor L1, L2, L3 and generates corresponding data signals. Depending on the design, the sensor system evaluates the data signals in such a way that the number of boarding passengers and the number of exiting passengers is determined for each floor L1, L2, L3. Such an evaluation can also be carried out by elevator control 12. Elevator system 1 utilizes this data and additional data that is present in the destination-call control to dynamically adapt the door dwell time for this floor L1, L2, L3.

In one exemplary embodiment, the sensor system comprises a camera system having a digital camera that, depending on its design, saves individual still images, in each case as a digital image, or (digital) video recordings on an internal or external storage medium. A digital image is, for example, in the JPEG format, but it can also be in a different format, for example, in the BMP format. A video recording can, for example, be in the MPEG, MWV or DivX or any other known format for digital video recordings. The sensor system also includes an image processing device that analyzes a digital image or a frame of the video recording according to desired criteria with the help of an image processing software. In the technology described here, the image processing software counts the number of recognizable people in a digital image or video frame. Software-implemented methods for counting people are known, for example, from D. Merad, et al., Fast People Counting Using Head Detection From Skeleton Graph, Proceedings of the 7th IEEE International Conference on Advanced Video and Signal Based Surveillance, 2010, pages 233-240.

Also known are commercially available systems for counting people, for example, the product "KiwiVision People Counter" from KiwiSecurity Software GmbH, which is suitable for counting people using surveillance cameras or 3D sensors, or the product "People Counter" from IEE S. A., which uses a 3D sensor. According to the product description of the IEE People Counter, the MLI (Modulated Light Intensity) technology of the 3D sensor is based on the optical time of flight (TOF) principle, where an active, non-scanning light source emits modulated near-infrared light. The system creates a real-time topographic image of a monitored area in 3D and processes the data to determine the number of people leaving the detection area of the People Counter.

The sensor system can be implemented flexibly and as required in elevator system 1. For example, a video camera can be arranged on each floor L1, L2, L3 as a sensor 4, wherein each video camera is connected to control device 8 via line 22 according to FIG. 1 in the exemplary embodiment. In another exemplary embodiment, a video camera is arranged in elevator car 10. If elevator system 1 has a plurality of elevator cars 10, a video camera can be arranged in each elevator car 10. It is also possible that video cameras are present both on the floors L1, L2, L3 and in each elevator car 10. If 3D sensors are used in the sensor system, they can be arranged in a similar manner. It goes without saying that there are lighting conditions on floors L1, L2, L3 and in each elevator car 10 having sensors 4 that make it possible to detect people.

Regardless of whether a video camera or a 3D sensor is arranged on a floor L1, L2, L3 or in elevator car 10, these components are each arranged in such a way that they have an optimized "field of view" of the desired monitoring area (e.g., the interior of elevator car 10, possibly oriented towards elevator door 6, or a lobby or entrance area to elevator door 6 on a floor L1, L2, L3) for the image evaluation. If these components are located on or near the ceiling (floor ceiling or car ceiling), observations from an elevated position are possible. In this case, the field of view of the components is also blocked the least by passengers standing in front. Moreover, the components are located as far outside of the reach of passengers as possible, which reduces the risk of vandalism.

If a video camera is used, an indicator (e.g., an LED-based light source) can be provided on the video camera or at another location visible to passengers that informs the passengers about the presence of the video camera or an operating status of the video camera. To protect the privacy of the passengers, the video camera can create an anonymized (e.g., blurry, pixelated, distorted and/or disguised) image of the monitoring area. However, it goes without saying that the task of the actual image evaluation, i.e. counting people, can still be performed reliably despite such image editing.

Elevator car 10 is usually designed for a fixed load that is indicated as a number of people or loading weight (e.g., in kilograms). Elevator car 10 is also equipped with a load measurement system 24 that determines the load. If the load is exceeded because, for example, too many passengers have boarded, the load measurement system indicates an overload condition and elevator control 12 prevents elevator door 6 from closing and thus prevents elevator car 10 from departing. In a different situation, load measurement system 24 does not determine any load (for example, no passengers enter an empty elevator car 10 on a boarding floor L1, L2, L3 despite a registered destination call). Load measurement system 24 also shows such an empty status. To avoid an empty trip, elevator control 12 deletes this destination call after a set wait time has elapsed. Depending on the design, car 10 can then move to the floor on which the main entrance to building 2 is located.

Known load measurement systems have, for example, one or more pressure sensors in the area of the car floor that are communicatively connected to elevator control 12. Load measurement system 24 can be viewed in an exemplary embodiment as part of the sensor system or as integrated into same.

The load measurement system 24 can be used in elevator system 1 in various ways. In one exemplary embodiment, load measurement system 24 can complement the determination of the number of passengers described above by being used, for example, for a plausibility check. For example, a decreasing number of passengers typically leads to a load reduction. In another exemplary embodiment, load measurement system 24 can be used to determine the number of passengers. In this case, the sensor system manages without cameras or 3D sensors in some circumstances. Load measurement system 24 can, for example, "count" passengers via a measurement of the load, wherein a certain weight is assumed for a passenger. If a passenger exits car 10 on a floor L1, L2, L3, load measurement system 24 detects a load decrease that corresponds to the weight of a passenger. If a passenger then enters car 10, load measurement system 24 detects a load increase.

Elevator car 10 also includes a safety device 26 that is coupled to door drive 7 and via line 20 to elevator control 12 in one exemplary embodiment. In one exemplary embodiment, safety device 26 includes at least one optical sensor or pressure sensor. The optical sensor can be part of a light barrier that monitors a plane in which elevator door 6 moves while closing and opening. If an obstruction is in the light path of the light barrier, the light path is interrupted, which results in the detection of an obstruction. The pressure sensor can be arranged on a front side of elevator door 6. If the front side encounters an obstruction, the pressure sensor detects the resulting pressure.

Regardless of the concrete design, safety device 26 detects an obstruction (e.g., a passenger or object) that is in the way of elevator door 6. Depending on the design, safety device 26 generates in such a case a corresponding sensor signal or sets a data output to a fixed value (e.g., logical "1"). If the sensor signal is present or if the data output is set, elevator door 6 cannot be closed. If elevator door 6 is already closing and an obstruction is then detected, the closing process is interrupted and elevator door 6 is opened all the way again.

In one exemplary embodiment, a floor terminal 5 is arranged on each floor L1, L2, L3, for example, in the area of the entrance to an elevator car 10. In one exemplary embodiment, floor terminal 5 includes a keyboard or a touch-sensitive screen (touchscreen) such that a passenger can enter a destination floor. In another exemplary embodiment, floor terminal 5 includes a device for detecting an authentication parameter that is assigned to a passenger. In one exemplary embodiment, this device is a reading device for an information carrier carried by a passenger. If the passenger presents the information carrier to the reading device, the reading device reads information from the information carrier, which is used, for example, to detect operating authorization. Only if the passenger is authorized to operate input terminal 5 can the passenger make an input. Depending on the design, a destination call can be triggered with the information that is read without further action on the part of the passenger.

In one exemplary embodiment, the information carrier has a card-like design in the form of, for example, a credit card or an employee ID card. Depending on the design, a memory chip that can be externally contacted, an RFID transponder in conjunction with a memory chip or an externally optically readable code, e.g., a QR code or bar code, is located in or on the information carrier. Alternatively, the functionality of the information carrier can also be realized on a portable electronic device (e.g., cell phone or smartphone). It is possible to show, for example, QR codes, bar codes or color pattern codes on the displays of such devices. Such devices also enable a wireless connection to other electronic devices, for example, via known wireless technologies such as Bluetooth or NFC. The reading device of floor terminal 5 is of course compatible with the technology used in the information carrier. Those skilled in the art also recognize that the reading device can also be configured for more than one technology. In another exemplary embodiment, the input authorization can also be done by the passenger using a key to unlock floor terminal 5 for an input.

Figure 2:
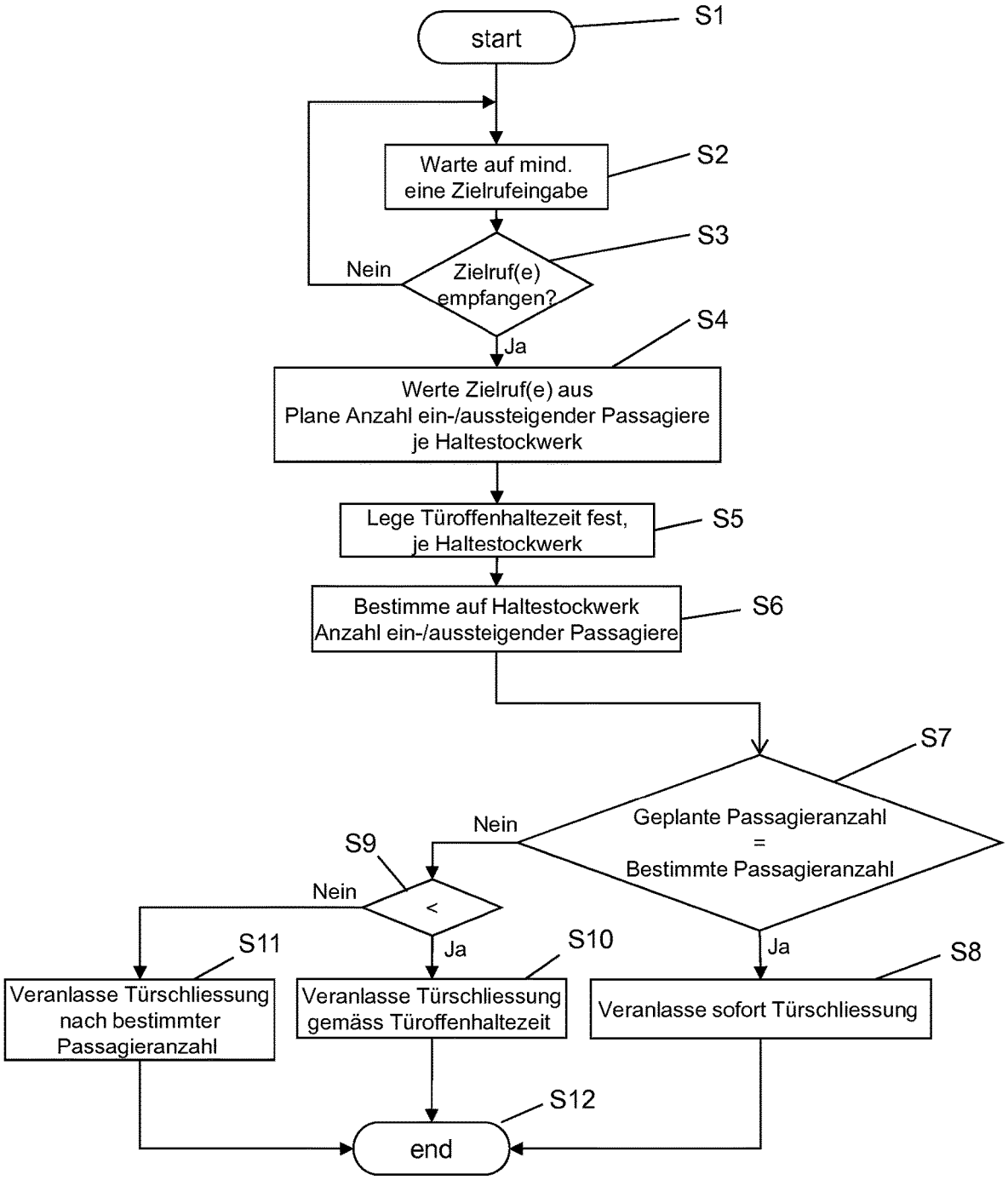
FIG. 2: an exemplary depiction of a method for controlling an elevator door by way of a schematic flow chart.

With the understanding of the structure of elevator system 1 and the functionalities of its components, a description will now be given of exemplary embodiments of a method for operating elevator system 1, in particular a method for controlling an elevator door 6 of an elevator car 10 in conjunction with FIG. 2. This figure shows an exemplary flow chart of a method for controlling elevator door 6 of elevator system 1. The method according to FIG. 2 begins in a step S1 and ends in a step S12.

In a step S2, the destination-call control waits for the input of at least one destination call. In a step S3, the destination-call control registers each destination call of a passenger, i.e. the boarding floor and the desired destination floor.

In a step S4, the destination-call control evaluates each destination call and subsequently assigns an elevator car 10 to each destination call. Depending on the design of elevator system 1 and the traffic situation, a single destination call and thus a single passenger can be assigned to an elevator car 10. In such a situation, elevator car 10 only stops on the boarding floor and the destination floor. Both floors are stopping floors from the perspective of elevator car 10. It is also possible to assign several destination calls and, thus, several passengers to an elevator car 10, possibly even with different destination floors. With different destination floors, elevator car 10 goes to more than two stopping floors. Because each destination call is registered and because it is generally determined for the destination-call control that the number of destination calls is equal to the number of passengers for an elevator trip, it is known after an evaluation of each destination call for each stop how many passengers exit there as planned and how many passengers board as planned.

In a step S5, a corresponding door dwell time of elevator door 6 is determined according to the information from the destination-call evaluation for each stopping floor L1, L2, L3 to allow a registered passenger to board or exit on a stopping floor. Depending on how many passengers board or exit, the door dwell time varies from floor to floor.

In a step S6, the number of passengers that exit elevator car 10 on the stopping floor and the number of passengers that board elevator car 10 on the stopping floor is determined. In practice, it may happen that passengers who have not entered a destination call and are therefore not registered board elevator car 10. For example, only one person in a group of colleagues may enter a destination call because all of them would like to go to the same floor. In such a case, the door dwell time determined based on the destination-call evaluation may be too short. For example, a closure of elevator door 6 can be initiated while passengers are still boarding. The closing process is then canceled and elevator door 6 is reopened. This delays the departure of elevator car 10, which in turn negatively affects the transport capacity.

The sensor system detects boarding and exiting passengers on a floor L1, L2, L3, for example, the number of people in the group of colleagues. In one exemplary embodiment, elevator control 12 receives data from the sensor system corresponding to the number of boarding passengers and the number of exiting passengers. If no passengers board or exit, the respective number is zero. In one exemplary embodiment, the number of passengers is determined and correspondingly evaluated continuously and repetitively.

In a step S7, the number of passengers boarding or exiting on a stopping floor, as determined by the sensor system, is compared to the planned number of passengers that board or exit on the stopping floor based on the destination-call evaluation. If there is no difference, i.e. the planned number of passengers is equal to the determined number of passengers, the method moves along the YES branch to a step S8, in which an immediate closure of elevator door 6 is triggered regardless of the door dwell time determined in step S5. The method ends in step S12 with the closing of elevator door 6.

If there is a difference after the comparison in step S7, the method moves along the NO branch to a step S9. If the planned number of passengers is lower than the determined number of passengers, the method moves along the YES branch to a step S10. In step S10, a closure of elevator door 6 is triggered according to the door dwell time determined in step S5. Here, the method also ends in step S12 with the closing of elevator door 6.

If in step S9 the planned number of passengers is higher (because it is not lower) than the determined number of passengers, the method proceeds along the NO branch to a step S11. In step S11, a closure of elevator door 6 is triggered if there is a passenger movement that corresponds to the number of passengers boarding and exiting on the stopping floor that was determined by sensor system 4. This therefore relates to a situation in which there is a period of waiting to close until elevator door 6 is no longer blocked by boarding and exiting passengers, the number of which was determined by sensor system 4, and safety device 26 "releases" elevator door 6. The method ends in step S12 with the closing of elevator door 6.

What is claimed is:

1. An elevator system comprising:

an elevator car arranged for movement between floors of a building, wherein the elevator car has an elevator door and a door control device for controlling the elevator door:

a control device communicatively connected to the door control device and arranged to evaluate registered destination calls placed by passengers that define a respective passenger's desired trip from a boarding floor to an exit floor, the control device further arranged to plan based on evaluation of the registered destination calls a number of boarding passengers and a number of exiting passengers for each stopping floor and set a corresponding door dwell time of the elevator door for each stopping floor to enable boarding and exiting at the stopping floors of the registered passengers; and a sensor system communicatively connected to the control device and arranged to determine a number of passengers actually exiting the elevator car at a stopping floor and a number of passengers actually entering the elevator car at the stopping floor;

wherein the control device is further arranged to cause the elevator door to close regardless of the set door dwell time if the number of passengers boarding on the stopping floor and the number of passengers exiting at the stopping floor as determined by the sensor system corresponds to the number of boarding passengers and the number of or exiting passengers planned for that stopping floor.

2. The elevator system according to claim 1, wherein the control device is further arranged to cause the elevator door to close according to the set door dwell time if the number of passengers boarding at the stopping floor and the number of passengers exiting at the stopping floor as determined by the sensor system is lower than the number of boarding passengers and the number of exiting passengers planned for the stopping floor.

3. The elevator system according to claim 1, wherein the control device is further configured to cause the elevator door to close if the number of passengers boarding on a stopping floor and the number of passengers exiting on a stopping floor as determined by the sensor system is higher than the number of boarding passengers and the number of exiting passengers planned for that stopping floor and when there is a passenger movement count that corresponds to the number of passengers boarding and the number of passengers exiting on the stopping floor determined by the sensor system.

4. The elevator system according to claim 1, wherein the elevator door has a safety device for detecting an obstruction in a doorway, wherein the safety device prevents the elevator door from closing if an obstruction is detected.

5. The elevator system according to claim 1, wherein the sensor system comprises a camera system with which the number of boarding and exiting passengers can be determined.

6. The elevator system according to claim 5, wherein a camera of the camera system is arranged on each floor, wherein a camera of the camera system is arranged on the elevator car or wherein a camera of the camera system is arranged on each floor and on the elevator car.

7. The elevator system according to claim 1, wherein the sensor system comprises a system having 3D sensors, with which the number of boarding and exiting passengers can be determined.

8. The elevator system according to claim 7, wherein at least one 3D sensor is arranged on each floor, wherein at least one 3D sensor is arranged on the elevator car or wherein at least one 3D sensor is arranged on each floor and on the elevator car.

9. The elevator system according to claim 1, further comprising a load measurement device that is at least partially arranged on the elevator car and is communicatively connected to the control device.

10. A method for controlling an elevator door of an elevator car that can be moved between floors of a building, comprising the following steps:

evaluating registered destination calls placed by passengers that define a respective passenger's desired trip from a boarding floor to an exit floor;

planning a number of boarding passengers and a number of exiting passengers for each stopping floor based on the destination call evaluations;

setting a corresponding door dwell time of the elevator door for each stopping floor to allow the passengers registered for that stopping floor to board and exit at that stopping floor;

determining an actual number of passengers that exit the elevator car at a respective stopping floor and an actual number of passengers that board the elevator car on that stopping floor by means of a sensor system; and triggering a closure of the elevator door regardless of the set door dwell time if the actual number of passengers boarding and the actual number of passengers exiting on a respective stopping floor as determined by the sensor system corresponds to the number of boarding passengers and the number of exiting passengers planned for that stopping floor.

11. The method according to claim 10, wherein the elevator door is closed according to the set door dwell time if the number of passengers determined to be boarding and exiting on the stopping floor is lower than the number of boarding or exiting passengers planned for the stopping floor.

12. The method according to claim 10, wherein, if the number of passengers determined to be boarding and exiting on a stopping floor is higher than the number of passengers planned for the stopping floor, the elevator door is closed if there is a passenger movement that corresponds to the number of passengers determined to be boarding and exiting on the stopping floor.

13. The method according to claim 10, further comprising preventing a closure of the elevator door if an obstruction is detected in the doorway.

* * * * *